US008065748B2

(12) United States Patent
Lucas, Jr.

(10) Patent No.: US 8,065,748 B2
(45) Date of Patent: Nov. 29, 2011

(54) CURVED SOCCER GOALKEEPER GLOVE

(76) Inventor: Alfred W Lucas, Jr., Honeoye Falls, NY (US)

( * ) Notice: Subject to any disclaimer, the term of this patent is extended or adjusted under 35 U.S.C. 154(b) by 983 days.

(21) Appl. No.: 12/017,109

(22) Filed: Jan. 21, 2008

(65) Prior Publication Data

US 2009/0183294 A1 Jul. 23, 2009

(51) Int. Cl.
*A41D 19/00* (2006.01)

(52) U.S. Cl. ..... 2/161.1

(58) Field of Classification Search ..... 2/161.1–161.8, 2/163, 167; 15/227; 441/57
See application file for complete search history.

(56) References Cited

U.S. PATENT DOCUMENTS

| | | | | |
|---|---|---|---|---|
| 241,964 | A | 5/1881 | Glidden | |
| 548,541 | A | 10/1895 | Heafield | |
| 613,847 | A | 11/1898 | Rue | |
| 883,761 | A | 4/1908 | Taylor | |
| 1,045,231 | A * | 11/1912 | Whitley | 2/19 |
| 1,083,795 | A | 1/1914 | Brokaw | |
| 1,284,178 | A | 11/1918 | Clarke | |
| 1,584,304 | A | 5/1926 | Kennedy | |
| 1,726,728 | A * | 9/1929 | Adams | 441/57 |
| 1,746,268 | A * | 2/1930 | Lepetich | 441/57 |
| 2,095,603 | A | 10/1937 | Langdon | |
| 3,333,850 | A | 8/1967 | Miller | |
| 3,347,547 | A | 10/1967 | Hynes | |
| 3,398,951 | A | 8/1968 | Disko | |
| 3,593,803 | A | 7/1971 | Ibach | |
| 3,597,765 | A | 8/1971 | Stanton | |
| 3,882,548 | A | 5/1975 | Shinagawa et al. | |
| 3,938,207 | A | 2/1976 | Drescher | |
| 3,944,220 | A | 3/1976 | Fasano | |
| 4,004,295 | A | 1/1977 | Byrnes, Sr. | |
| 4,295,229 | A | 10/1981 | Clark et al. | |
| 4,669,991 | A | 6/1987 | Southworth | |
| 4,720,875 | A | 1/1988 | Latina et al. | |
| 4,881,275 | A | 11/1989 | Cazares et al. | |
| 5,018,221 | A | 5/1991 | Romandetto | |
| 5,058,209 | A | 10/1991 | Eisenberg | |
| 5,113,526 | A | 5/1992 | Wang et al. | |
| 5,373,585 | A | 12/1994 | Wiggins | |
| 5,409,447 | A | 4/1995 | Wedge, Jr. | |
| 5,487,188 | A | 1/1996 | Micheloni et al. | |
| 5,500,956 | A | 3/1996 | Schulkin et al. | |
| 5,511,244 | A | 4/1996 | Shikatani | |
| 5,608,912 | A * | 3/1997 | Cumberland | 2/16 |
| 5,781,929 | A | 7/1998 | Shikatani | |
| D416,111 | S | 11/1999 | Talarico | |
| 6,065,155 | A | 5/2000 | Sandusky | |
| 6,088,835 | A | 7/2000 | Perkins et al. | |
| 6,381,753 | B1 * | 5/2002 | Smith et al. | 2/167 |
| 6,427,250 | B1 * | 8/2002 | Stull et al. | 2/161.6 |
| 6,543,058 | B2 | 4/2003 | Litke | |
| 6,654,965 | B2 * | 12/2003 | Hochmuth | 2/161.1 |
| 6,772,441 | B2 * | 8/2004 | Lucas, Jr. | 2/161.1 |

* cited by examiner

*Primary Examiner* — Katherine Moran
(74) *Attorney, Agent, or Firm* — Eugene S. Stephens, PC

(57) ABSTRACT

Confronting intra-finger gussets, peripheral banding strips, and stitching lines extending from wrist to fingertip across a palm face of a soccer goalkeeper glove help to hold the glove in a curved configuration that protects the fingers and thumb of the wearer from bending backward when hit by a soccer ball. These features, alone, or in various combinations, also contribute to a realistic feel in handling a ball.

19 Claims, 4 Drawing Sheets

CURVED SOCCER GOALKEEPER GLOVE

TECHNICAL FIELD

Gloves for soccer goalkeepers

BACKGROUND

This invention results from experience in making and using soccer goalkeeper gloves such as described in my U.S. Pat. No. 6,772,441. The improvements accomplished by this invention help make a soccer goalkeeper glove achieve its original purpose of protecting a goalkeeper's fingers from injury while giving the goalkeeper a feel for handling the ball.

SUMMARY

The improved glove accomplishes this by adding three structures, usable singly or in any combination to better hold the palm and fingers of the glove to the curvature of a surface approximating that of a soccer ball. This then helps resist any back bending of the thumbs and fingers from being struck by a soccer ball. The curvature conforming features of the glove also allow comfortable finger and thumb movements by the wearer of the gloves to give the wearer a realistic feel while handling the ball.

The curvature conforming structures include first, curved gussets forming confronting intra-finger surfaces to help hold the glove fingers to a curved shape. Second, a mesh material laminated into a palm face of the glove is secured with stitching along lines extending from a wrist region of the glove to the tips of the thumb and fingers of the glove. The stitching along these lines reduces any tendency of the palm face materials to stretch, which helps hold the palm and fingers to the desired curvature. Third, a length of stretch-resistant banding material has its ends secured to a wrist region of the glove and extends around the perimeter of the glove where the banding material is secured to the tips of the thumb and fingers of the glove. This helps the fingers reinforce each other and resists back bending of any one of the fingers or thumbs.

DRAWINGS

DETAILED DESCRIPTION

Figure 5:
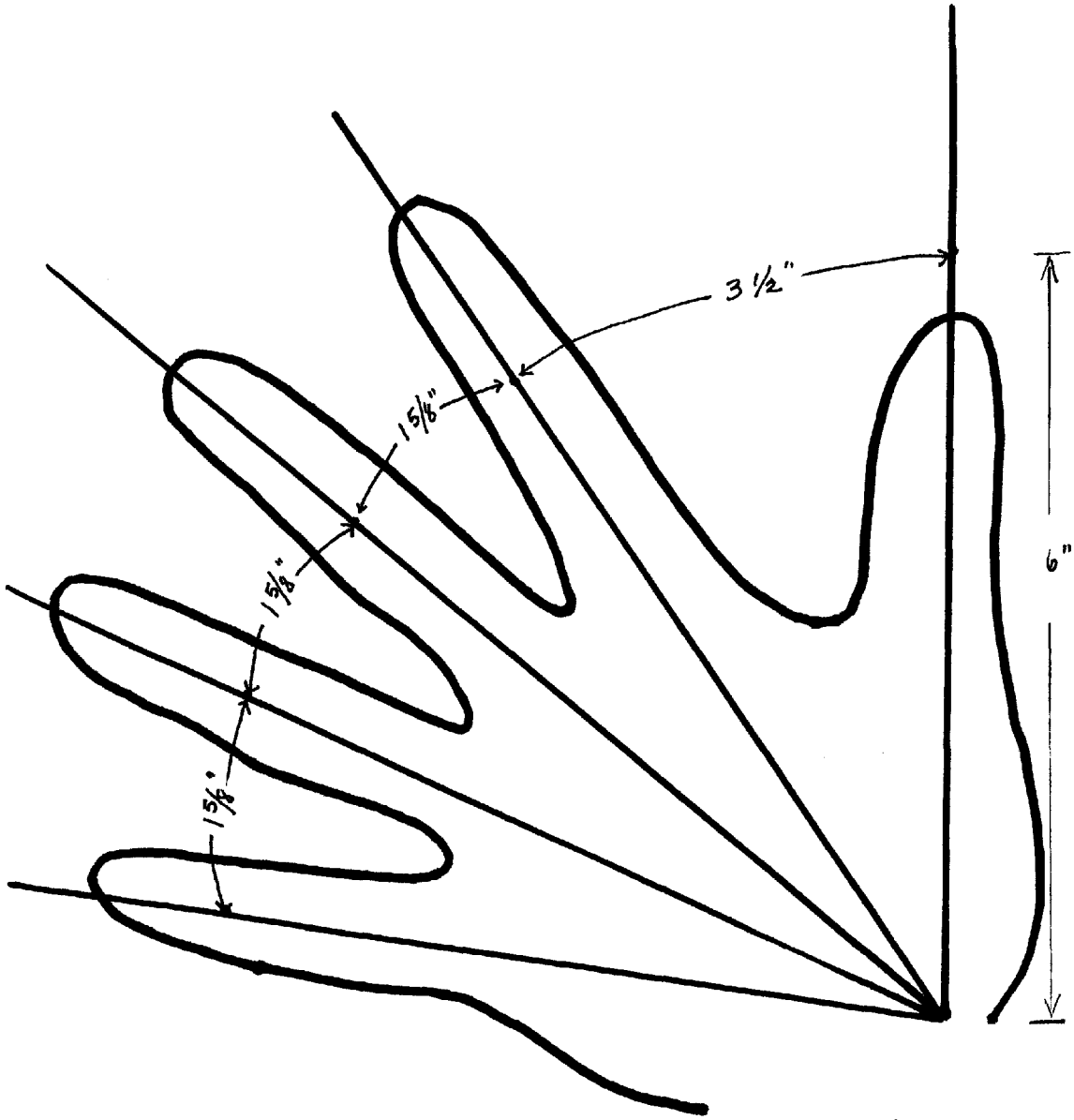
FIG. 5 is a schematic view of a hand showing preferred paths for tendon line stitching and showing that such tendon lines converge at a wrist region of the glove.

Lines 11-15 of stitching secure together a mesh material 26 and a palm face material 27 of glove 10. The lines 11-15 preferably extend from wrist region 20 to finger tips 21-24 and thumb tip 25. With such an arrangement, stitching lines 11-15 generally follow tendon lines from a wrist region to the tips of fingers and thumbs. These tendon lines converge at a wrist region of the glove as shown in FIG. 5.

The advantage of stitching lines 11-15 is to restrain any stretching movement of mesh material 26 or palm material 27 in the direction of the stitching lines. This can allow mesh and palm materials 26 and 27 to stretch laterally somewhat in inter-finger regions, and laterally across the palm face, but the stitchings inhibit the mesh material from stretching in the direction of the stitch lines. This helps keep the fingers and palm of the glove conformed to a curved surface having a radius that is approximate to, or somewhat smaller than, a radius of a soccer ball. This also inhibits any back bending of the thumb and fingers when hit by a soccer ball.

Stretch resistant banding strip 30 preferably extends from wrist region 20 along opposite sides of glove 10 and over the tips of fingers 21-24 and thumb 25. Banding material 30 is preferably stitched or otherwise secured to glove 10 along its entire perimeter extent. This preferably includes attaching banding strip 30 to each finger and thumb tip and to mesh material 26 in intra-finger regions, as well as along side surfaces of glove 10 extending from wrist region 20. Alternatively, banding material 30 can be stitched or secured to the sides of the glove and to the thumb and finger tips, without being stitched or secured to mesh 26.

Banding material 30 helps limit perimeter movement around the glove and thus helps the fingers and thumb support each other against bending backward when hit by a soccer ball. Banding 30 also helps keep the glove in its desired curvature.

Figure 3:
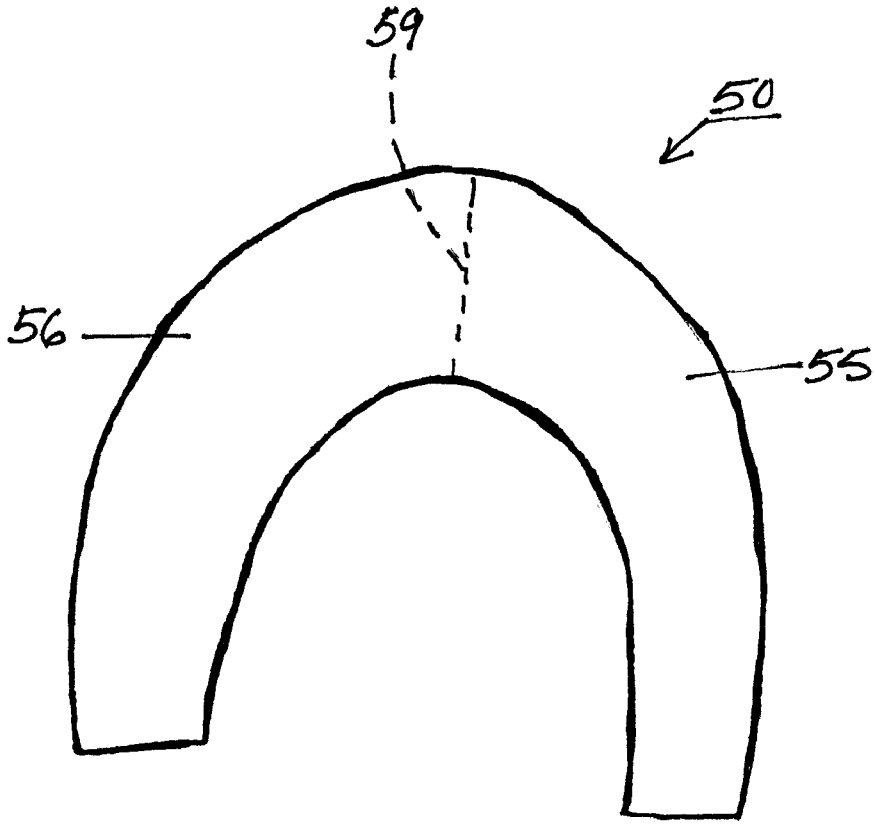
FIG. 3 is a plan view of an intra-finger gusset used in the glove of FIGS. 1 and 2.

Gussets 50 are preferably formed in a U-shape such as shown in FIG. 3 with a fold line 59 allowing each gusset to be folded approximately in half at a mid-region of its U-shape. The fold region 59 is then located at a proximal region of the glove fingers, so that the folded halves of each gusset confront each other in intra-finger regions. Gusset halves 51 and 52 thus confront each other between glove fingers having finger tips 21 and 22, gusset halves 53 and 54 confront each other between glove fingers having tip regions 22 and 23, and so on. A gusset having halves 57 and 58 confronting each other between a thumb and index finger are shaped differently with gusset half 57 being longer than gusset half 58 to fit appropriately to a glove shape conforming to a human hand.

Figure 1:
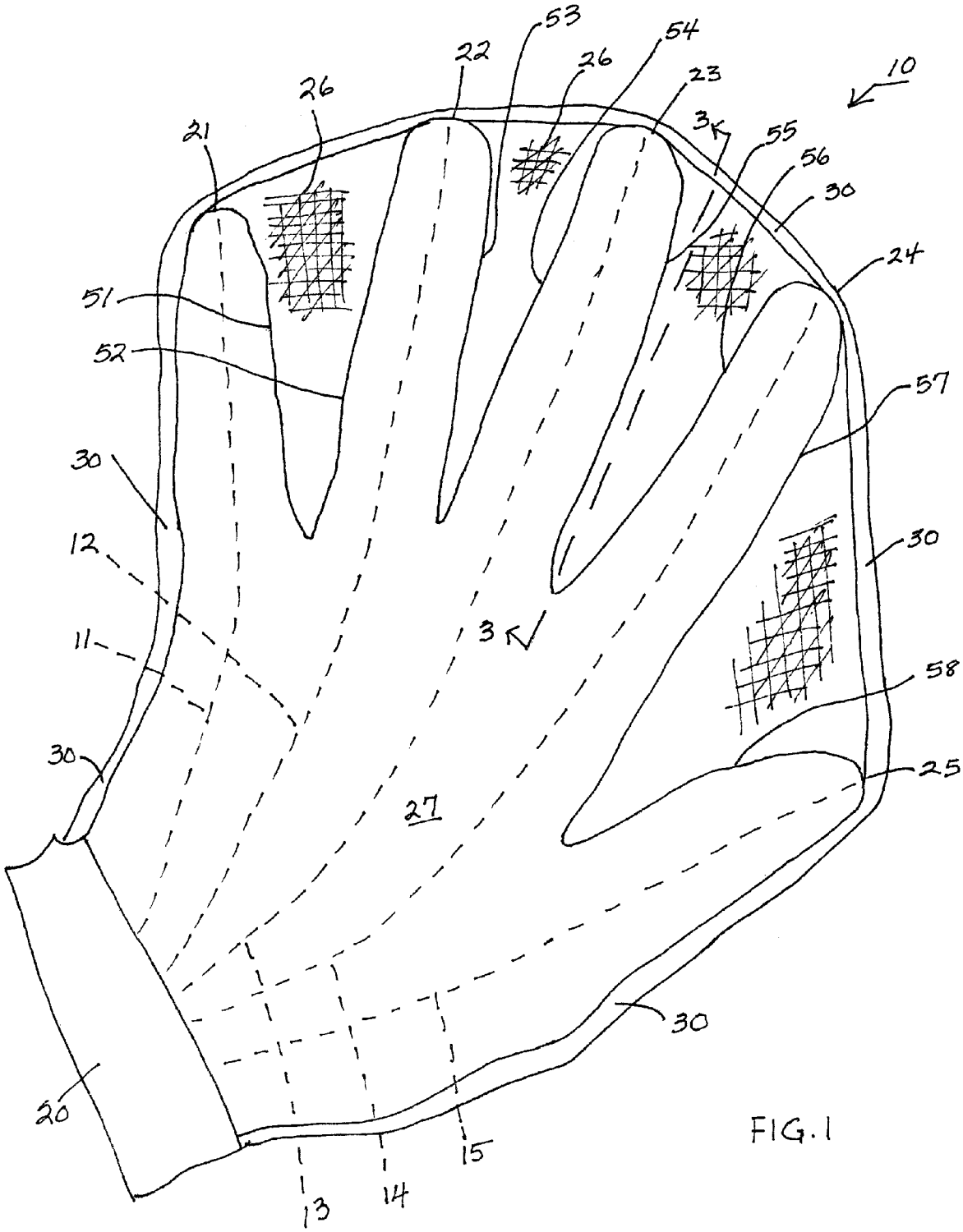
FIG. 1 is a partially schematic plan view of the inventive improvements in a soccer goalkeeper glove.
Figure 2:
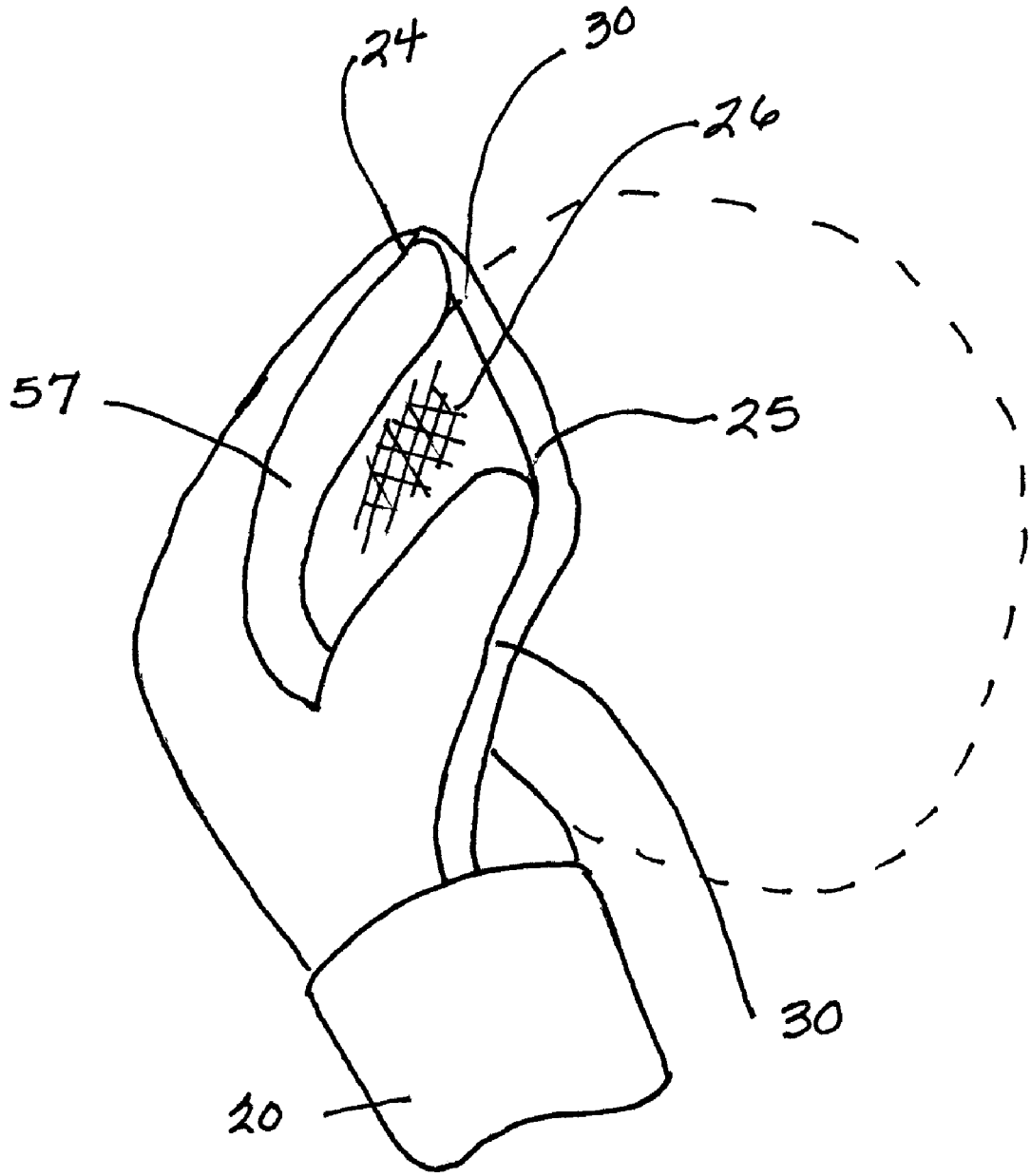
FIG. 2 is a partially schematic side view of the glove of FIG. 1 conformed to a curvature approximating that of a soccer ball.
Figure 4:
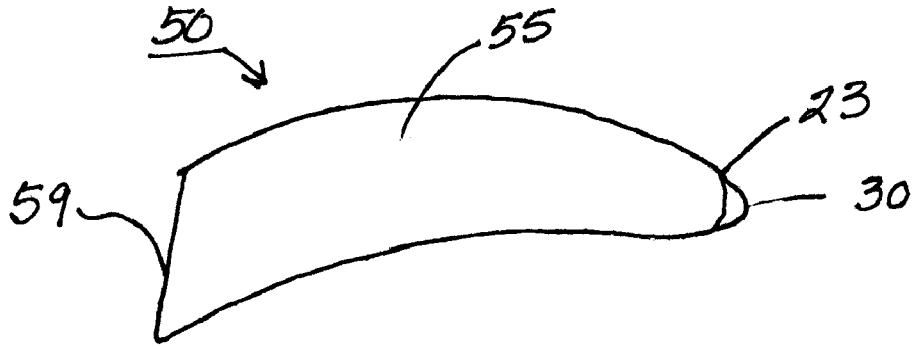
FIG. 4 is a side elevation of the gusset of FIG. 3, taken along the line 3-3 of FIG. 1, to show the finger curving effect of the gusset.

The halves of each folded gusset are curved, as best shown in FIG. 4, and this curvature helps hold the glove fingers and thumb to the curved shape shown in FIG. 2. It also helps prevent finger injury and facilitates a sensitive feel of a ball being handled. Gussets can also be arranged on the outside of a thumb and little finger, but it was found that the perimeter banding has greater effect in maintaining the desired curvature rather than using gussets in these areas.

The finger gussets, the stitch lines along converging tendon paths, and the peripheral banding material all cooperate in holding a gloved hand to a curved surface and resisting back bending of fingers or thumbs struck by a soccer ball. These three improvements can be used separately or in different combinations, since each improvement contributes to the goal of protecting a goalkeeper's fingers while allowing a goalkeeper to have a realistic feel for handling a ball. The intra-finger mesh 26 and the banding material 30 are preferably arranged to allow fingers of a goalkeeper's hand to spread as widely apart as active spreading allows, but no further than that. This allows a goalkeeper to spread fingers and thumbs while reaching for an oncoming ball, and facilitates a realistic ball handling feel. Limiting finger spread beyond the active limit also helps resist back-bending of fingers. A blow from a soccer ball tending to bend a finger back may also tend to increase the intra-finger angle, which both the intra-finger mesh and the peripheral banding material resists.

FIG. 5 shows not only the convergence at the wrist of tendon stitch lines, but also shows approximate preferred spacing of fingers at an active limit. Since hands differ in size and finger length, at a 6" radius from the wrist the thumb and finger spread is about 3½", and spreads between the four fingers are about 1⅝" at the 6" radius. These preferred finger and thumb spreads approximate the active limit for the human hand, which may be adjusted over time as our research indicates more optimal measurements in this regard. The glove structure then resists spreading beyond the active limit.

What is claimed is:

1. A soccer goalkeeper glove having a thumb, fingers and a curved palm face, the glove comprising:

gussets arranged to form confronting intra-finger surfaces of the glove;

the gussets being curved to conform the fingers to the curvature of the palm face;

a mesh material laminated into the palm face of the glove;

stitching securing the mesh material to the palm face of the glove along stitch lines;

the stitch lines extending from a wrist region of the glove to tips of the thumb and fingers;

the stitch lines reducing any stretching of the glove along the stitch lines;

a length of stretch resistant banding material having opposite ends secured to a wrist region of the glove, the banding material extending around a perimeter of the glove from the wrist region along sides of the glove and over the tips of the fingers and thumb of the glove; and the banding material being secured to the tips of the fingers and thumb of the glove.

2. The glove of claim 1 wherein the gussets are folded at a proximal region of the fingers so that a single gusset provides a pair of the confronting intra-finger surfaces.

3. The glove of claim 1 wherein the banding material is secured to the mesh material in intra-finger regions.

4. The glove of claim 1 wherein the stitching, banding and gussets of the glove resist finger and thumb spreading beyond an active limit.

5. A soccer goalkeeper glove having a thumb and fingers and a curved palm face, the glove comprising:

confronting intra-finger surfaces of the glove being formed with gussets;

the gussets being formed in a U shape;

the gussets being folded at a mid-region of the U-shape:

the folds of the gussets being positioned at a proximal region of the fingers of the glove so that a single gusset provides a pair of the confronting intra-finger surfaces;

the confronting intra-finger surfaces of the gussets being curved along a distance between the proximal folds and tips of the fingers of the glove; and the curvature of the confronting intra-finger surfaces conforming the fingers of the glove to the curvature of the palm face.

6. The glove of claim 5 wherein the glove includes four gussets, three of which are interposed between four fingers, and a fourth of which is interposed between a thumb and index finger.

7. The glove of claim 5 including a mesh laminated into the palm face, and stitched to the palm face along lines running from a wrist region of the glove to tips of the thumb and each of the fingers of the glove.

8. The glove of claim 5 including a stretch-resistant banding material extending between tips of the thumb and each of the fingers of the glove, the banding material being secured to the tips of the thumb and fingers of the glove and to a wrist region of the glove.

9. The glove of claim 5 wherein the gussets of the glove allow finger and thumb spreading up to an active limit, and the glove resists finger and thumb spreading beyond the active limit.

10. A soccer goalkeeper glove having fingers and a thumb and a curved palm face including a mesh material formed into the palm face of the glove to extend from a wrist region to tips of a thumb and fingers, the glove comprising:

stitching securing the mesh material to the palm face of the glove along stitch lines;

a stretch-resistant banding material having opposite ends secured to the wrist region of the glove, and the banding material is arranged to extend from the wrist region to and between the tips of each of the thumb and fingers of the glove;

the banding material being secured to the mesh material between the tips of each of the thumb and fingers of the glove;

the stitch lines extending from the wrist region to the tips of the thumb and fingers; and the stitching reducing any stretching of the glove along the stitch lines.

11. The glove of claim 10 including curved gussets forming confronting intra-finger surfaces of the glove to conform the fingers to the curved palm face.

12. The glove of claim 10 wherein the banding material and the mesh material of the glove allow finger and thumb spreading up to an active limit and resist finger and thumb spreading beyond the active limit.

13. A soccer goalkeeper glove having a thumb, fingers, a wrist region and a curved palm face, the glove comprising:

a length of a stretch-resistant banding material having opposite ends secured to opposite sides of the wrist region of the glove;

the banding material extending around a perimeter of the glove from the wrist region along a side of the glove, over tips of the fingers and thumb of the glove, and back along an opposite side of the glove to the wrist region of the glove;

the banding material being secured to the wrist region and to the tips of the fingers and thumb of the glove; and curved gussets folded and secured to fingers of the glove to provide curved confronting intra-finger surfaces that conform the fingers of the glove to the curved palm face.

14. The glove of claim 13 wherein a mesh material is laminated into the palm face of the glove and extends between the thumb and fingers of the glove, and the banding material is secured to inter-finger regions of the mesh material.

15. The glove of claim 13 wherein the curved gussets are U-shaped and curve from a fold region to fingertip regions of the glove.

16. The glove of claim 13 including a mesh laminated into the palm face, and stitched to the palm face along lines running from the wrist region of the glove to tips of a thumb and each of the fingers of the glove.

17. The glove of claim 13 wherein the banding material of the glove allows finger and thumb spreading up to an active limit and resists finger and thumb spreading beyond the active limit.

18. A method of forming a thumb, fingers and a palm face of a soccer goalkeeper glove to a curvature to reduce injuries to a wearer of the glove from impacts with soccer balls, the method comprising:

forming the glove to have at least one of two curvature conformance features comprising:

1) arranging gussets to form confronting intra-finger surfaces of the glove;

folding the gussets in half and positioning the gusset folds at proximal regions of the fingers of the glove;

curving the gussets from the fold regions to tips of the fingers to conform the confronting intra-finger surfaces to the curvature; and 2) arranging a length of a stretch-resistant banding material to have each opposite end secured to a wrist region of the glove, with the banding material extending around a perimeter of the glove from the wrist region along the sides of the glove and over the tips of the fingers and thumb of the glove and securing the banding material to the tips of the fingers and thumb of the glove.

19. The method of claim 18 including forming at least one of the two conformance compliance features so that the glove allows spreading of the fingers and thumb to an active limit and the glove resists spreading the fingers and thumb beyond the active limit.

* * * * *